US011717764B2

(12) United States Patent
Tiefel et al.

(10) Patent No.: US 11,717,764 B2
(45) **Date of Patent: *Aug. 8, 2023**

(54) CASCADING JUMPING TOYS AND THE ASSOCIATED METHOD OF OPERATION

(71) Applicant: Doozi, LLC, Burlington, NJ (US)

(72) Inventors: Simeon E. Tiefel, Siloam Springs, AR (US); Michael J. Goldman, Delran, NJ (US)

(73) Assignee: DOOZI, LLC, Burlington, VT (US)

( * ) Notice: Subject to any disclaimer, the term of this patent is extended or adjusted under 35 U.S.C. 154(b) by 95 days.

This patent is subject to a terminal disclaimer.

(21) Appl. No.: 17/359,113

(22) Filed: Jun. 25, 2021

(65) Prior Publication Data

US 2022/0193565 A1 Jun. 23, 2022

Related U.S. Application Data

(63) Continuation-in-part of application No. 17/131,095, filed on Dec. 22, 2020, now Pat. No. 11,077,380.

(51) Int. Cl.
*A63H 11/06* (2006.01)
*A63H 37/00* (2006.01)

(52) U.S. Cl.
CPC ..... *A63H 11/06* (2013.01); *A63H 37/005* (2013.01)

(58) Field of Classification Search
CPC ..... A63H 37/005; A63H 11/06; A63F 9/28
See application file for complete search history.

(56) References Cited

U.S. PATENT DOCUMENTS

| | | | | |
|---|---|---|---|---|
| 1,362,248 A | | 12/1920 | Ford | |
| 1,384,046 A | | 7/1921 | Carrino | |
| 2,297,759 A | | 10/1942 | Fomas | |
| 2,535,868 A | * | 12/1950 | Rolando | A63H 11/06 446/311 |
| 2,776,525 A | * | 1/1957 | Ford | A63H 11/06 446/199 |

(Continued)

FOREIGN PATENT DOCUMENTS

FR 2892318 A1 * 4/2007 ..... A63H 13/16

OTHER PUBLICATIONS

Translation FR2892318A1 (Year: 2007).*

*Primary Examiner* — Eugene L Kim
*Assistant Examiner* — Alyssa M Hylinski
(74) *Attorney, Agent, or Firm* — LaMorte & Associates P.C.

(57) ABSTRACT

A jumping toy and the methodology of creating a cascading arrangement of multiple jumping toys. Each jumping toy has a first segment and a second segment that are connected at a joint. The first segment and the second segment can rotate about the joint between a first configuration and a second configuration. Each jumping toy has a biasing element that biases the jumping toy toward its second configuration. Each jumping toy is stable in its first configuration and quickly transforms into its second configuration once it is slightly displaced out of its first configuration. The rapid change in configuration makes the bi-stable toy jump. A plurality of bi-stable toys can be overlapped into a cascading chain. The first toy in the cascading chain is triggered. The movement of the first toy triggers the next toy in the chain in a cascade.

15 Claims, 10 Drawing Sheets

(56) References Cited

U.S. PATENT DOCUMENTS

| | | | | |
|---|---|---|---|---|
| 3,378,947 | A * | 4/1968 | Zimmerman | A63H 33/00 446/311 |
| 3,526,991 | A | 9/1970 | Goidfarb et al. | |
| 4,138,797 | A | 2/1979 | Stolar | |
| 4,363,184 | A | 12/1982 | Marcolina | |
| 5,038,532 | A * | 8/1991 | Shahinpoor | E04B 1/3441 52/109 |
| 6,086,449 | A * | 7/2000 | Sharp | A63H 33/103 446/4 |
| 7,803,033 | B1 | 9/2010 | Walterscheid | |
| 9,095,781 | B2 | 8/2015 | Tiefel et al. | |
| 9,212,863 | B1 * | 12/2015 | Weinstock | A63H 37/005 |
| 10,006,195 | B2 * | 6/2018 | Matsuoka | F16M 11/38 |
| 11,077,380 | B1 * | 8/2021 | Tiefel | A63H 11/06 |
| 2004/0104532 | A1 * | 6/2004 | Ben-Yaakov | A63F 9/02 273/342 |
| 2007/0032710 | A1 | 2/2007 | Raridan et al. | |
| 2008/0166519 | A1 * | 7/2008 | Leung | E04B 1/00 428/120 |
| 2008/0233832 | A1 | 9/2008 | Lirot | |
| 2009/0071137 | A1 * | 3/2009 | Harris | A63H 13/00 446/176 |
| 2013/0149936 | A1 * | 6/2013 | Tiefel | A63H 37/005 446/486 |
| 2014/0232128 | A1 | 8/2014 | Cho | |
| 2014/0273707 | A1 * | 9/2014 | Becker | A63H 30/00 446/4 |
| 2015/0089974 | A1 * | 4/2015 | Seo | A44C 5/0076 63/1.13 |
| 2017/0144082 | A1 * | 5/2017 | Blow | A63H 33/08 |
| 2018/0155922 | A1 * | 6/2018 | Matsuoka | A63H 33/00 |

* cited by examiner

CASCADING JUMPING TOYS AND THE ASSOCIATED METHOD OF OPERATION

RELATED APPLICATIONS

This application is a continuation-in-part of co-pending U.S. patent application Ser. No. 17/131,095, filed Dec. 22, 2020.

BACKGROUND OF THE INVENTION

1. Field of the Invention

In general, the present invention relates to the structure of toys that jump or pop up from a surface when activated. More particularly, the present invention relates to jumping toys that can be used to activate a cascade where the activation of one jumping toy triggers the activation of subsequent jumping toys.

2. Prior Art Description

Toys that jump or otherwise pop up into the air from a set position have existed for over a century. In this long history, jumping toys and pop-up toys have been manufactured in numerous shapes, styles, and models. The force utilized to make a toy jump typically comes from either a metal spring or an elastic band. The toy is commonly cocked, by compressing the spring or stretching the elastic band. The toy jumps when the energy from the spring or elastic band is released.

In a simple form, toys that jump can be cocked by pressing a spring-loaded component on the toy against a hard surface. The compression of the toy against a surface stores energy in a spring or elastic band. The toy can be triggered simply by releasing the toy. Such prior art jumping toys are exemplified by U.S. Pat. No. 1,362,248 to Ford. To add to the play value of the toy, delay mechanisms are added to the toy that cause the toy to trigger and jump a short time after the toy is cocked. Such delays are often achieved using suction cups that delay a triggering mechanism for the period of time that the suction cup can hold suction. Such prior art toys with suction cup delays are exemplified by U.S. Pat. No. 2,297,759 to Fornas and U.S. Pat. No. 3,526,991 to Goldfarb.

In the science of toy design, there is another commonly used delay mechanism that has been incorporated into jumping toys. This other delay comes from the use of spring-loaded constructs that are bi-stable. That is, the toys are stable both when fully cocked and when fully uncocked. However, should the toy be even slightly moved away from its fully cocked configuration, the toy will become unstable and the stored spring energy will release to move the toy to its fully uncocked configuration. Such bi-stable jumping toys are exemplified by U.S. Patent Application Publication No. 2008/0233832 to Lirot, U.S. Pat. No. 7,803,033 to Walterscheid, and U.S. Pat. No. 9,095,781 to Tiefel. During play, such prior art bi-stable toys are typically cocked into a first stable configuration. When cocked, the toy stores energy. The toy is then thrown or dropped. When the toy strikes another surface, the toy is momentarily deformed. This moves the toy out of its first stable configuration and releases the stored spring energy. The toy then pops into a second stable configuration, wherein the released energy causes the toy to rebound from the surface that was impacted. Manufacturing a toy with such bi-stable characteristics requires precision tooling and often requires the use of metal components.

Although prior art bi-stable toys provide interesting play, there is room for improvement. The present invention is an improved bi-stable toy that can be manufactured easily and inexpensively. Furthermore, the bi-stable toy can be used in a cascade, wherein the triggering of one bi-stable toy can be used to trigger any plurality of subsequent bi-stable toys. The details of the improved bi-stable toy are described and claimed below.

SUMMARY OF THE INVENTION

The present invention is a jumping toy and the methodology of creating a cascading arrangement from multiple jumping toys. Each jumping toy has a first segment and a second segment that are connected at a joint. The first segment and the second segment can rotate about the joint between a first configuration and a second configuration.

Each jumping toy has a biasing element that biases the jumping toy toward its second configuration. Each jumping toy is stable in its first configuration and quickly transforms into its second configuration when it is slightly displaced out of its first configuration. Once moved, the spring energy in the biasing element releases and the bi-stable toy rapidly moves into its second configuration. The rapid change in configuration makes the bi-stable toy jump.

A plurality of bi-stable toys can be overlapped into a cascading chain. The first toy in the cascading chain is triggered. The movement of the first toy triggers the next toy in the chain. The process cascades until all the bi-stable toys in the cascading chain trigger.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention jumping toy system can be embodied in many ways, only a few exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered a limitation when interpreting the scope of the claims.

Figure 1:
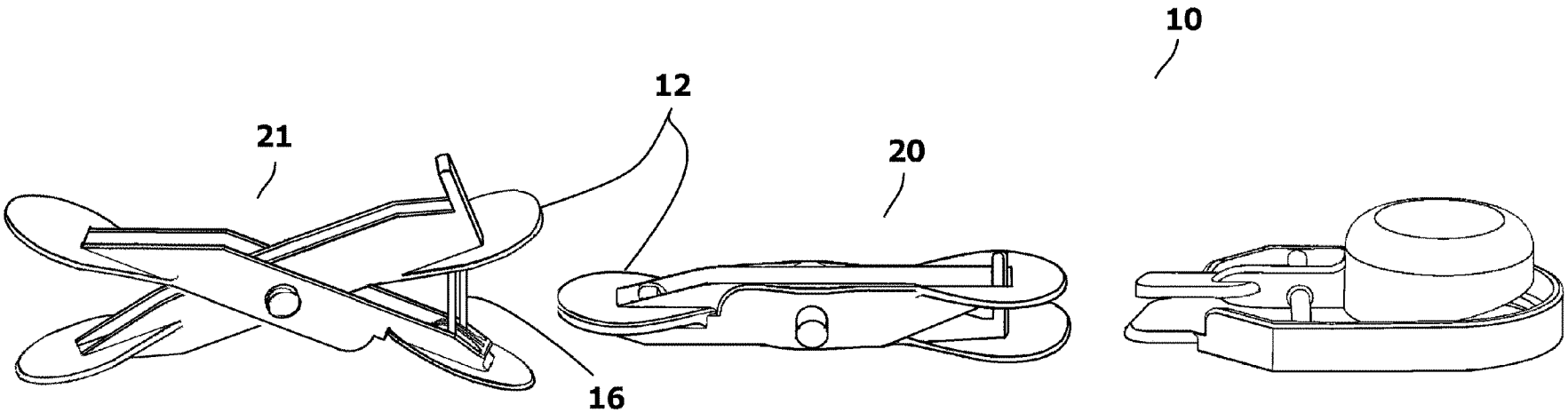
FIG. 1 shows an exemplary embodiment of a jumping toy system consisting of a triggering mechanism and bi-stable assemblies.

Referring to FIG. 1, a jumping toy system 10 is shown. The jumping toy system 10 includes a plurality of bi-stable assemblies 12 and a triggering mechanism 14. As will be explained in detail, each of the bi-stable assemblies 12 contains a biasing element, such as an elastic band 16. Furthermore, each of the bi-stable assemblies 12 is stable in both a cocked first configuration 20 and an uncocked second configuration 21. In the first configuration 20, the elastic band 16 is taut and retains significant spring energy. In the second configuration 21, the elastic band 16 retains no significant spring energy. It should be understood that although an elastic band 16 is illustrated, other biasing elements, such as metal coil springs and ribbon springs, can also be used.

Figure 2:
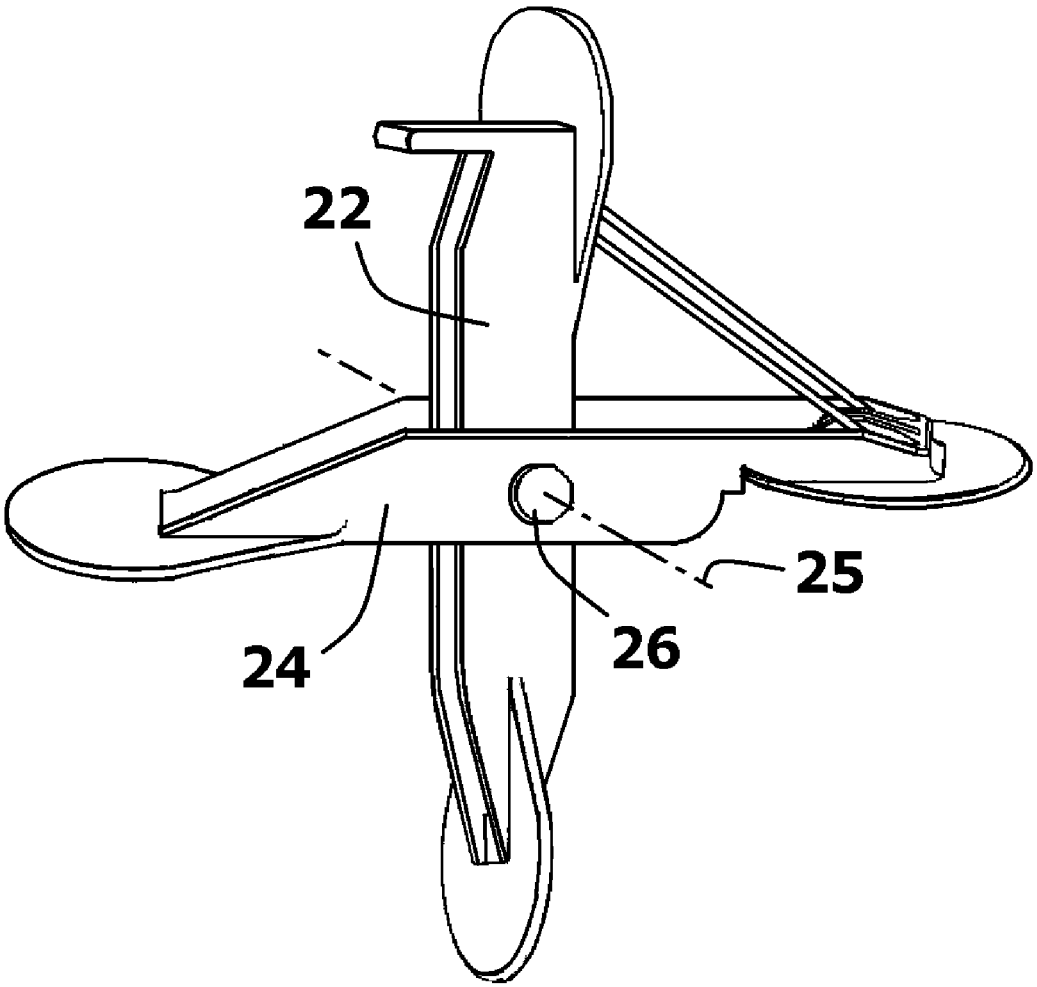
FIG. 2 is a side view of a bi-stable assembly.

Referring to FIG. 2 in conjunction with FIG. 1, it can be seen that each bi-stable assembly 12 includes a first segment 22 and a second segment 24, wherein the first segment 22 and the second segment 24 are separate and distinct. Both the first segment 22 and the second segment 24 are joined at a scissor joint 26. The scissor joint 26 enables rotational movement around a pivot axis 25. As a consequence, both the first segment 22 and the second segment 24 can independently rotate about the pivot axis 25 while remaining interconnected as an assembly.

Figure 3:
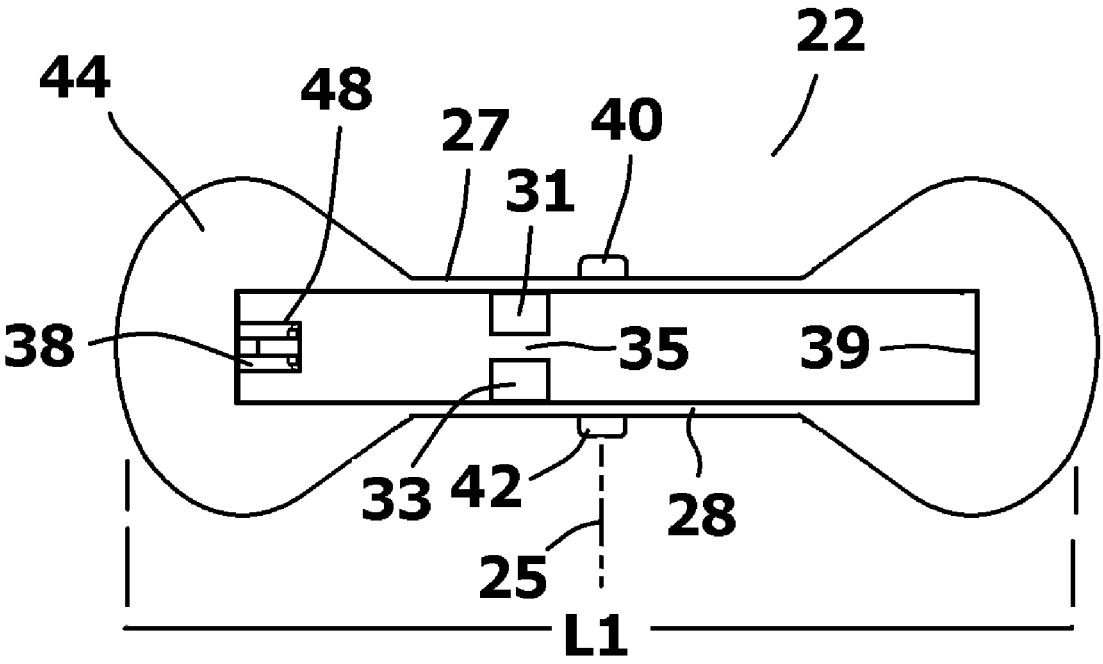
FIG. 3 is a top view of a first element in the bi-stable assembly.
Figure 4:
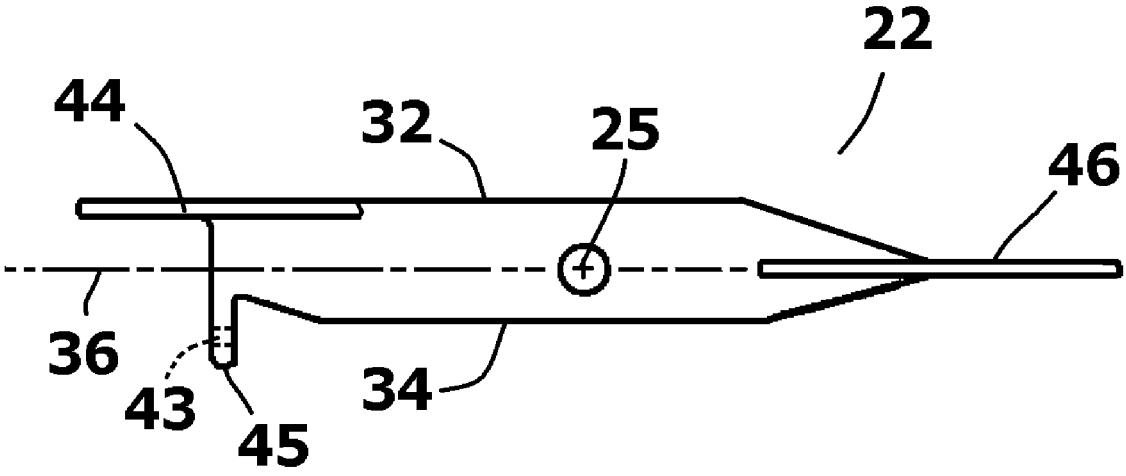
FIG. 4 is a side view of the first element shown in FIG. 3.

Referring to FIG. 3 and FIG. 4, in conjunction with FIG. 2, it can be seen that the first segment 22 has a first length L1. The first segment 22 includes two parallel side walls 27, 28. The side walls 27, 28 are spaced apart and define opposite parallel sides of a first open slot 30. Each of the sidewalls 27, 28 has a top edge 32, a bottom edge 34, and a midline 36 that is halfway between the top edge 32 and the bottom edge 34. The first open slot 30, defined by the sidewalls 27, 28, extends between a first end 38 and an opposite second end 39. Two pivot pins 40, 42 extend outwardly from the side walls 27, 28 at a perpendicular. The pivot pins 40, 42 extend from the midline 36 of the side walls 27, 28 and are concentric with the pivot axis 25 of the scissor joint 26.

A wide first flange 44 extends outwardly from the first end 38 of the first open slot 30. The first flange 44 is flat and extends in a plane that is perpendicular to the side walls 27, 28. As such, the plane of the first flange 44 is parallel to the midline 36 of the sidewalls 27, 28. Although parallel, the first flange 44 is not aligned with the midline 36 of the side walls 27, 28. Rather, the plane of the first flange 44 aligns with the top edge 32 of the side walls 27, 28.

A wide second flange 46 extends outwardly from the second end 39 of the first open slot 30. The second flange 46 is flat and extends in a plane that is perpendicular to the side walls 27, 28. As such, the plane of the second flange 46 is parallel to the midline 36 of the side walls 27, 28. Furthermore, the second flange 46 is coplanar with the midline 36 of the side walls 27, 28. As such, the plane of the second flange 46 is parallel to, but offset from, the plane of the first flange 44.

A first anchor hook 48 is provided that extends into the first open slot 30 from the first end 38 of the first open slot 30. The anchor hook 48 is used to engage the elastic band 16, as is later explained. Additionally, an optional post 45 may extend below the bottom edge 34 of the sidewalls 27, 28. The post 45 contains a hole 43 that is used to secure the bi-stable assembly 12 in its cocked first configuration 20, as is later explained.

Two baffle tabs 31, 33 extend into the first open slot 30 from the side walls 27, 28. The baffle tabs 31, 33 are positioned on or near the midline 36 of the first segment 22. There is an opening 35 between the baffle tabs 31, 33. The opening 35 is wide enough to enable the elastic band 16 to pass there through. The baffle tabs 31, 33 create a delay mechanism that slows the movement of the bi-stable assembly 12 from its first configuration 20 to its second configuration 21, as is later explained.

Figure 5:
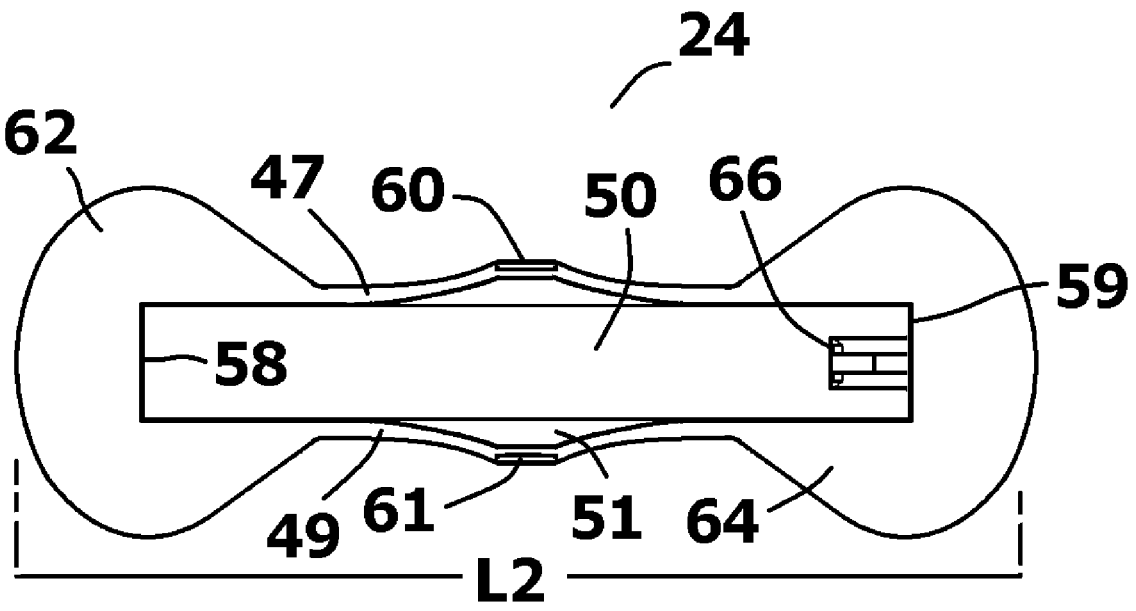
FIG. 5 is a top view of a second element in the bi-stable assembly.
Figure 6:
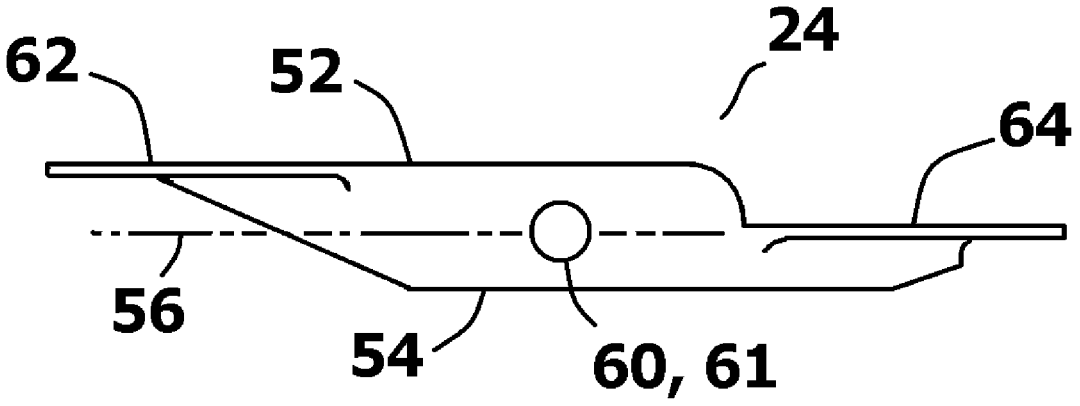
FIG. 6 is a side view of the second element shown in FIG. 5.

Referring to FIG. 5 and FIG. 6, in conjunction with FIG. 2, it can be seen that the second segment 24 has a second length L2. The second length L2 of the second segment 24 is equal to the first length L1 of the first segment 22. The second segment 24 includes two side walls 47, 49. The side walls 47, 49 are spaced apart and define opposite parallel sides of a second open slot 50. The side walls 47, 49 can be flared to create a saddle receptacle 51. The saddle receptacle can be used to retain a secondary object, such as a ball, as is later explained. Each of the side walls 47, 49 includes a top edge 52, a bottom edge 54, and a midline 56 that is halfway between the top edge 52 and the bottom edge 54. The second open slot 50 defined by the side walls 47, 49 extends between a first end 58 and an opposite second end 59. Two pivot holes 60, 61 are formed in the side walls 47, 49. The pivot holes 60, 61 are concentric with the pivot axis 25 of the scissor joint 26.

A wide third flange 62 extends outwardly from the first end 58 of the second open slot 50. The third flange 62 is flat and extends in a plane that is generally perpendicular to the side walls 47, 49. As such, the plane of the third flange 62 is parallel to the midline 56 of the side walls 47, 49. Although parallel, the third flange 62 is not aligned with the midline of the side walls 47, 49. Rather, the plane of the third flange 62 aligns with the top edge 52 of the side walls 47, 49.

A wide fourth flange 64 extends outwardly from the second end 59 of the second open slot 50. The fourth flange 64 is flat and extends in a plane that is parallel to the third flange 62. As such, the plane of the fourth flange 64 is parallel to the midline 56 of the side walls 47, 49. Furthermore, the fourth flange 64 is coplanar with the midline 56 of the side walls 47, 49. As such, the plane of the fourth flange 64 is parallel to, but offset from, the plane of the third flange 62.

A second anchor hook 66 is provided that extends into the second open slot 50 from the second end 59 of the second open slot 50. The second anchor hook 66 is used to engage the elastic band 16. The elastic band 16 is stretched between the second anchor hook 66 on the second segment 24 and the first anchor hook 48 on the first segment 22, as is later explained.

Figure 7:
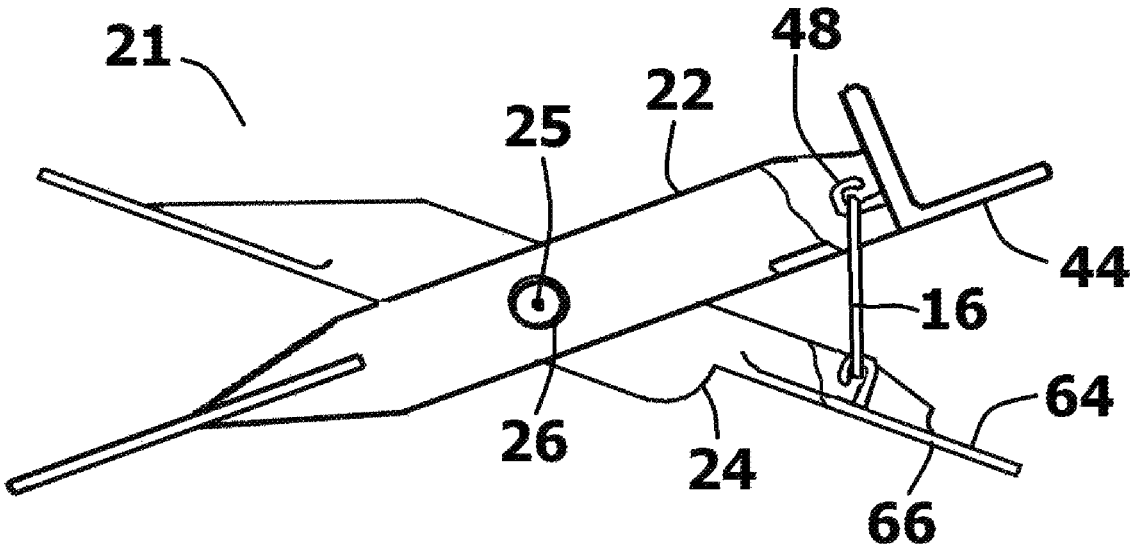
FIG. 7 is a cross-sectional view of the bi-stable assembly in its second stable configuration.

Referring to FIG. 7, in conjunction with FIGS. 3 through 6, it can be seen that the first segment 22 passes through the second open slot 50 of the second segment 24. As a consequence, the side walls 27, 28 of the first segment 22 are inside the side walls 47, 49 of the second segment 24. The pivot pins 40, 42 extending from the first segment 22 pass into the pivot holes 60, 61 on the second segment 24. This creates the scissor joint 26 between the first segment 22 and the second segment 24. The elastic band 16 engages both the first anchor hook 48 on the first segment 22 and the second anchor hook 66 on the second segment 24. The elastic band 16 rotates both the first segment 22 and the second segment 24 about the pivot axis 25 by biasing the first flange 44 on the first segment 22 toward the fourth flange 64 on the second segment 24.

It can be seen that in an uncocked second stable configuration 21, the elastic band 16 moves the first flange 44 of the first segment 22 toward the fourth flange 64 on the second segment 24 until the first flange 44 contacts the side walls 47, 49 of the second segment 24. This acts as a mechanical stop, wherein the overall bi-stable assembly 12 is positionally stable. In this second stable configuration 21, the elastic band 16 is only slightly stretched.

Figure 8:
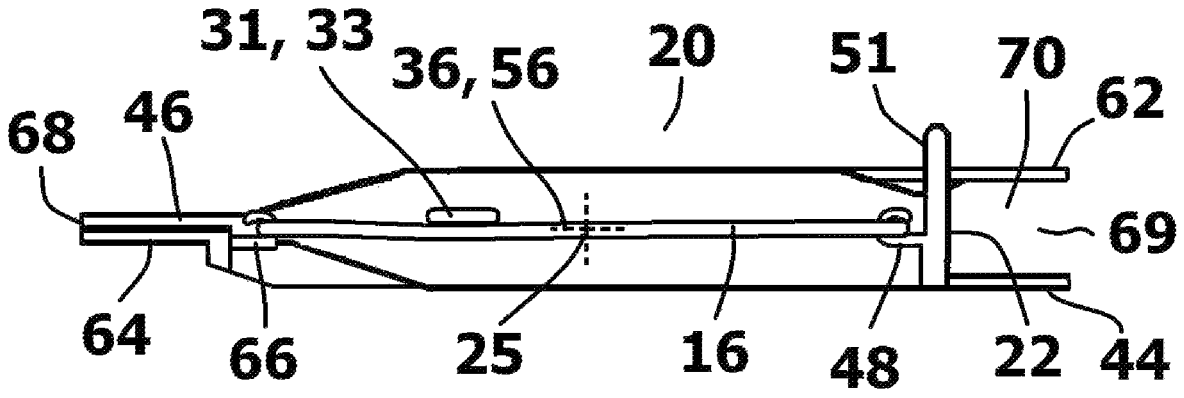
FIG. 8 is a cross-sectional view of the bi-stable assembly in its first stable configuration.

Referring to FIG. 8 in conjunction with FIG. 3 through FIG. 6, it can be seen that the first segment 22 and the second segment 24 can be rotated about the scissor joint 26 in opposition to the bias of the elastic band 16. The first flange 44 on the first segment 22 rotates toward the third flange 62 on the second segment 24. The rotation also causes the second flange 46 on the first segment 22 to rotate toward the fourth flange 64 on the second segment 24. When fully rotated to the shown cocked first stable configuration 20, the second flange 46 is between 1 degree and four degrees away from the fourth flange 64, therein providing the bi-stable assembly 12 with a cocked first end 68. In this first stable configuration 20, the midline 36 of the first segment 22, the midline 56 of the second segment 24, and the pivot axis 25 of scissor joint 26 are all aligned in a common plane. Furthermore, in this first stable configuration 20, the elastic band 16 is stretched taut between the first anchor hook 48 and the second anchor hook 66. The first anchor hook 48 and the second anchor hook 66 hold the stretched elastic band 16 in the same plane as the pivot axis 25 of the scissor joint 26. As such, the stretched elastic band 16 creates no torque forces around the scissor joint 26 and the bi-stable assembly 12 is stable with a stretched elastic band 16.

In the first stable configuration 20, the first flange 44 and the second flange 46 of the first segment 22 are parallel with, or within a few degrees of parallel, with the third flange 62 and the fourth flange 64 of the second segment 24. The second flange 46 and the fourth flange 64 are adjacent to each other at the cocked first end 68. However, at the opposite cocked second end 69 of the bi-stable assembly 12, the first flange 44 and the third flange 62 are widely spaced apart. This forms a gap space 70 between the second flange 46 and the fourth flange 64. The presence of the gap space 70 on the cocked second end 69 and the lack of a gap space on the cocked first end 68 is important for positioning the multiple bi-stable assemblies 12 into a cascading formation.

Additionally, it can be seen that when the bi-stable assembly 12 is in its first configuration 20, the post 45 on the first segment 22 extends through and beyond the second segment 24.

From FIG. 8 and FIG. 7, it can also be seen that when the bi-stable assembly 12 is in its cocked first configuration 20, the elastic band 16 is taut. The elastic band 16 moves through the opening 35 between the two baffle tabs 31, 33 and is positioned below the baffle tabs 31, 33 when fully taut. When the bi-stable assembly 12 moves out of its cocked first configuration 20 and towards the uncocked configuration 21, the elastic band 16 temporarily snags on the baffle tabs 31, 33 before passing through the opening 35 between the baffle tabs 31, 33. This slows the transition between the cocked first configuration 20 of FIG. 8 and the uncocked second configuration 21 of FIG. 7. The baffle tabs 31, 33 therefore create a delay mechanism that can delay the triggering of the bi-stable assembly for up to one second. The amount of the delay can be adjusted by adjusting the size of the baffle tabs 31, 33 and the size of the opening 35 in between the baffle tabs 31, 33.

Figure 9:
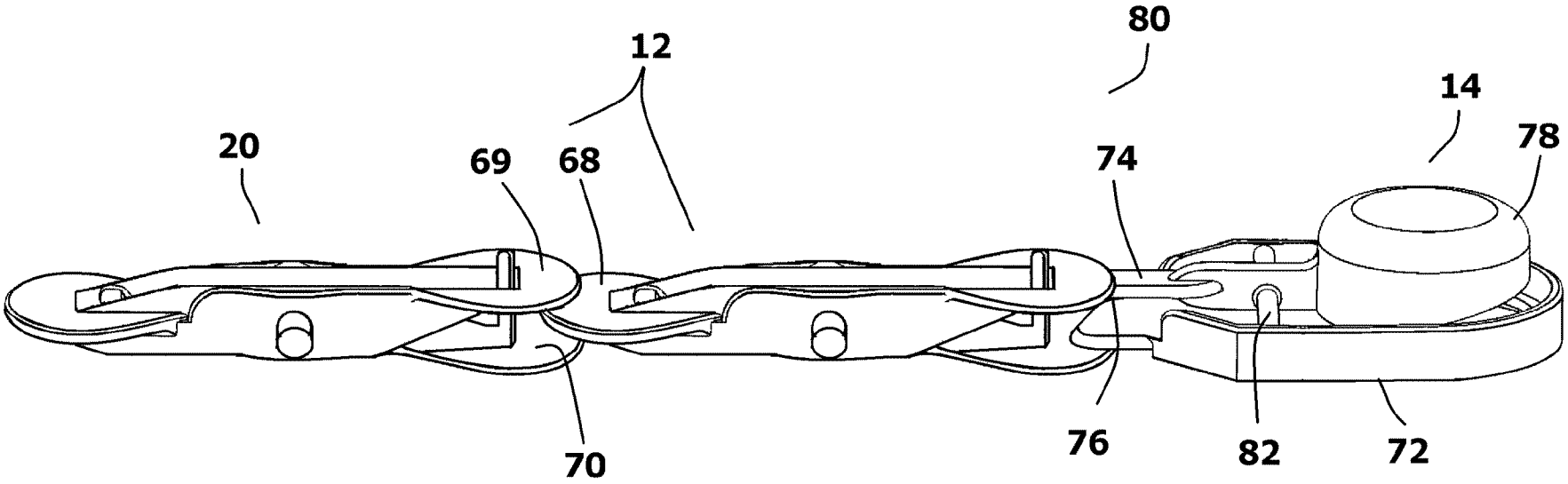
FIG. 9 shows the full jumping toy system arranged into a first cascading chain with the bi-stable assemblies in their first stable configurations.

Referring to FIG. 9 in conjunction with FIG. 1, multiple bi-stable assemblies 12 are shown in conjunction with the triggering mechanism 14. The triggering mechanism 14 consists of a base 72 with an elevated lever 74. The elevated lever 74 has a first end 76 and an opposite second end 78. The elevated lever 74 has a fulcrum 82. As a result, the first end 76 of the lever 74 rises when the second end 78 of the lever 74 is depressed.

To create a cascading chain 80, multiple bi-stable assemblies 12 are positioned into their cocked first stable configurations. As a result, each of the bi-stable assemblies 12 will have stretched elastic bands 16. Furthermore, each of the bi-stable assemblies 12 will have a cocked first end 68 with no gap space and a second cocked end 69 with a gap space 70. A plurality of bi-stable assemblies 12 are interpositioned. The cocked first end 68 of a first bi-stable assembly 12 is positioned into the gap space 70 at the second cocked end 69 of a subsequent bi-stable assembly 12. This process can be continued indefinitely to produce a cascading chain 80 of bi-stable assemblies 12. The cascading chain 80 will begin with the cocked first end 68 of a bi-stable assembly 12 and will end with the cocked second end 69 of a different bi-stable assembly 12 with any number of additional bi-stable assemblies 12 interposed therebetween.

Figure 10:
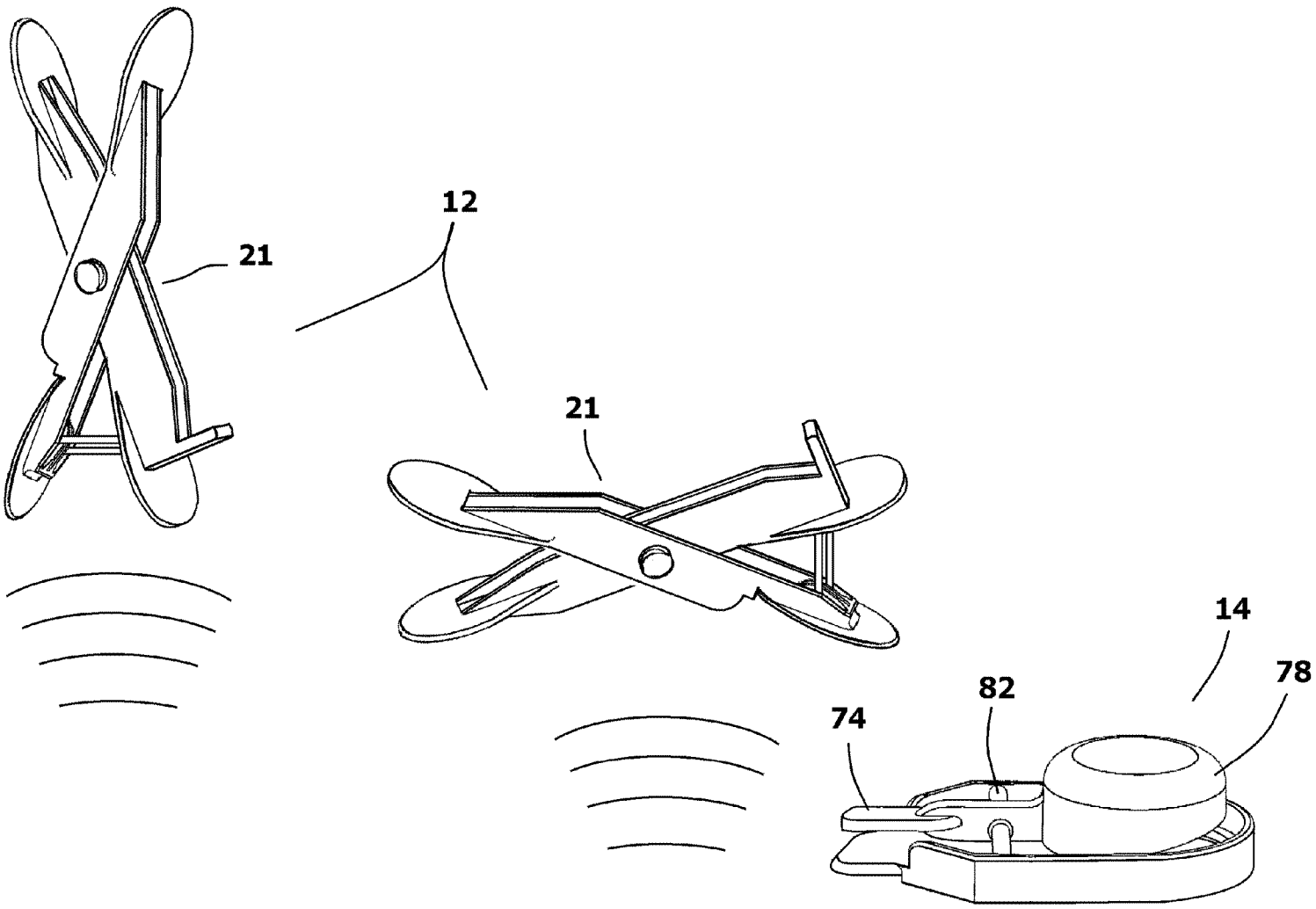
FIG. 10 shows the full jumping toy system of FIG. 9 with the bi-stable assemblies triggered to their second stable configurations.

The base 72 and the first end 76 of the lever 74 are inserted into the gap space 70 at one end of the cascading chain 80. To trigger the cascading chain 80, the second end 78 of the elevated lever 74 is depressed. The elevated lever 74 rocks about the fulcrum 82, wherein the first end 76 and the lever 74 spread. The base 72 and the first end 76 of the lever 74, spread the first flange 44 and the third flange 62 apart. The moment the first flange 44 and the third flange 62 move apart, the bi-stable assembly 12 leaves its cocked first stable configuration 20. The energy held in the stretched elastic band 16 is triggered and released. Referring to FIG. 10 in conjunction with FIG. 9, it will be understood that the elastic band 16 snaps the bi-stable assembly 12 into its uncocked second stable configuration 21. The rapid release of spring energy makes the bi-stable assembly 12 jump into the air as the first and second segments 22, 24 rotate and contact the ground. Furthermore, as the bi-stable assembly 12 moves from its first stable configuration 20 to its second stable configuration 21, the first flange 44 and the third flange 62 spread apart. This triggers the next subsequent bi-stable assembly 12 in the cascading chain 80. This cascading reaction repeats until all the bi-stable assemblies 12 in the cascading chain 80 have been triggered.

Figure 11:
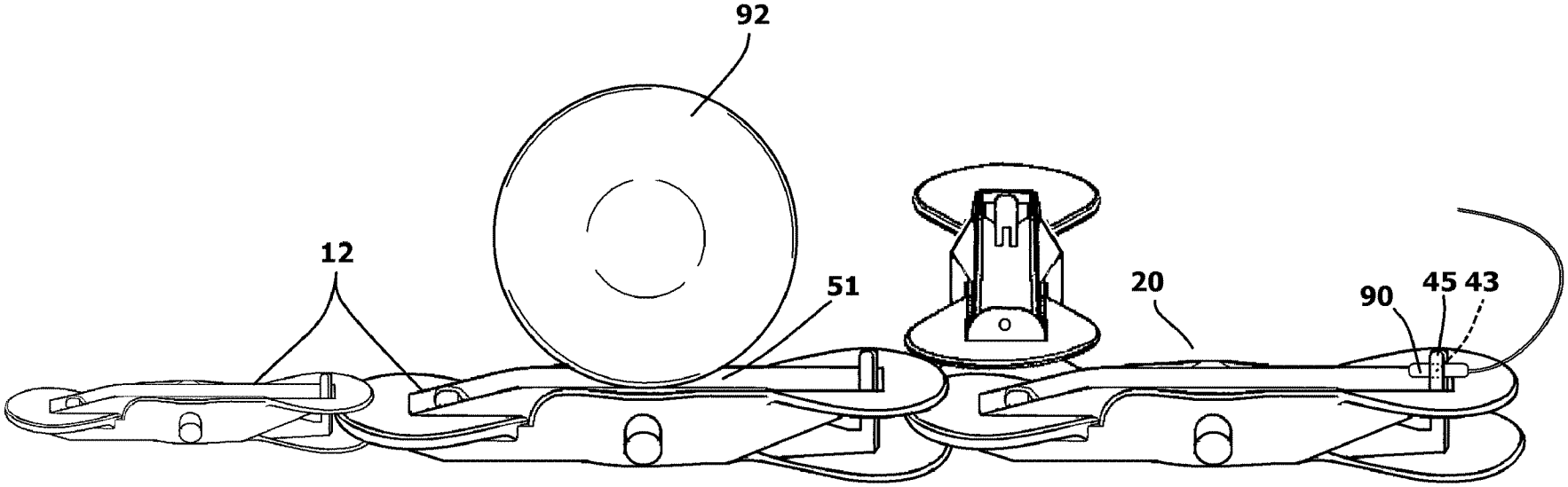
FIG. 11 shows the full jumping toy system arranged into a second cascading chain with the bi-stable assemblies in their first stable configurations and shown in conjunction with an auxiliary ball.
Figure 12:
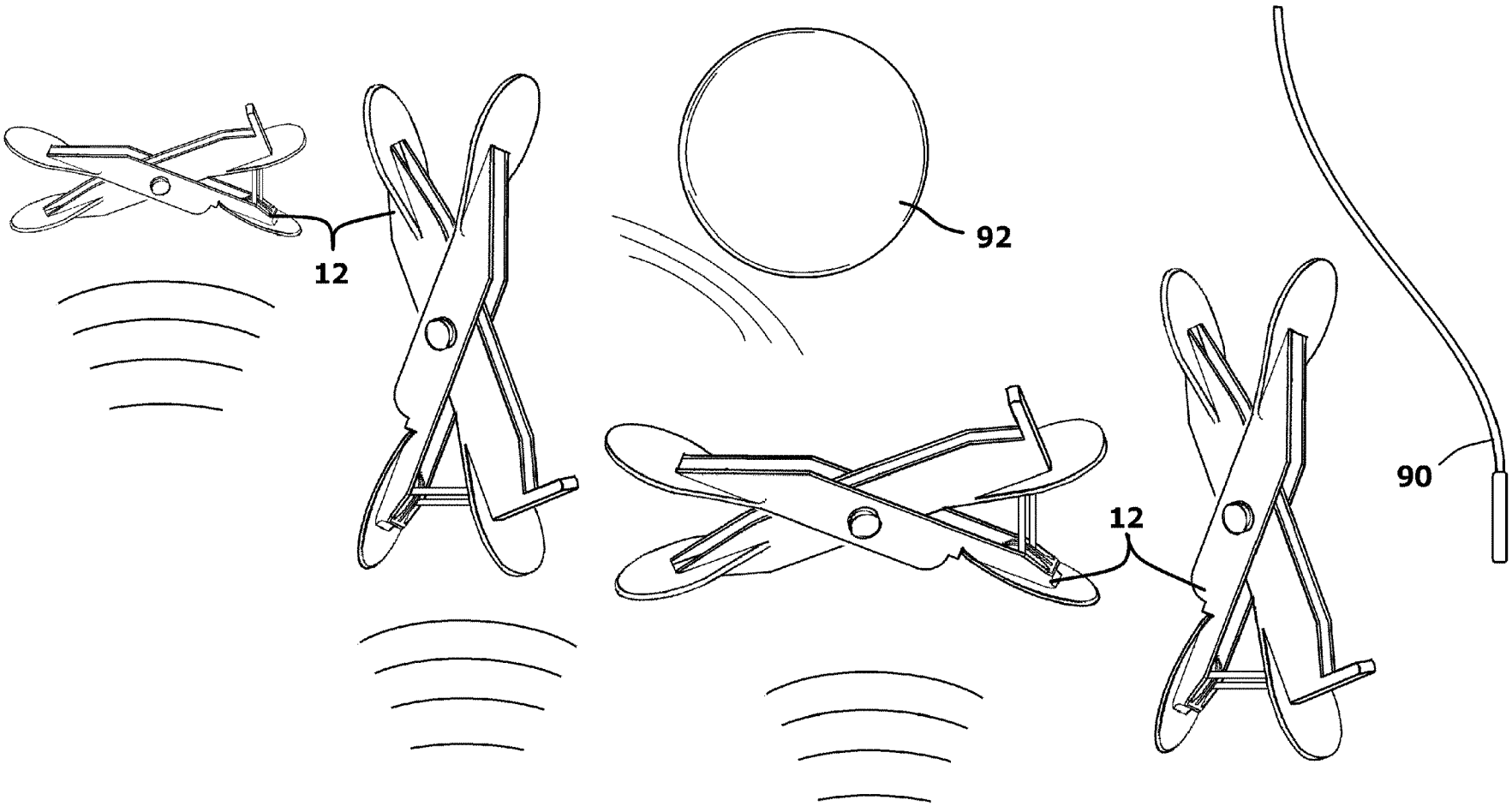
FIG. 12 shows the full jumping toy system of FIG. 11 with the bi-stable assemblies triggered to their second stable configurations.

Referring to FIG. 11 and FIG. 12, it can be seen that different cascade configurations can be used. Bi-stable assemblies 12 of different sizes can be interpositioned. Furthermore, multiple bi-stable assemblies can be triggered by a single bi-stable assembly, if desired.

Furthermore, a safety pin 90 can be placed through the hole 43 in the post 45 of the first segment 22. The presence of the safety pin 90 locks the bi-stable assembly 12 into its cocked first configuration 20. This enables the bi-stable assemblies 12 to be positioned and otherwise manipulated by a user without accidentally triggering the bi-stable assembly 12. Once the bi-stable assemblies 12 are in place, the safety pins 90 can be removed.

FIG. 11 and FIG. 12 also show that a secondary object, such as a ball 92 can be placed atop the bi-stable assembly 12 when it is in its cocked first configuration 20. When the bi-stable assembly 12 triggers to its second configuration 21, the ball 92 is launched into the air as the bi-stable assembly 12 changes shape.

Figure 13:
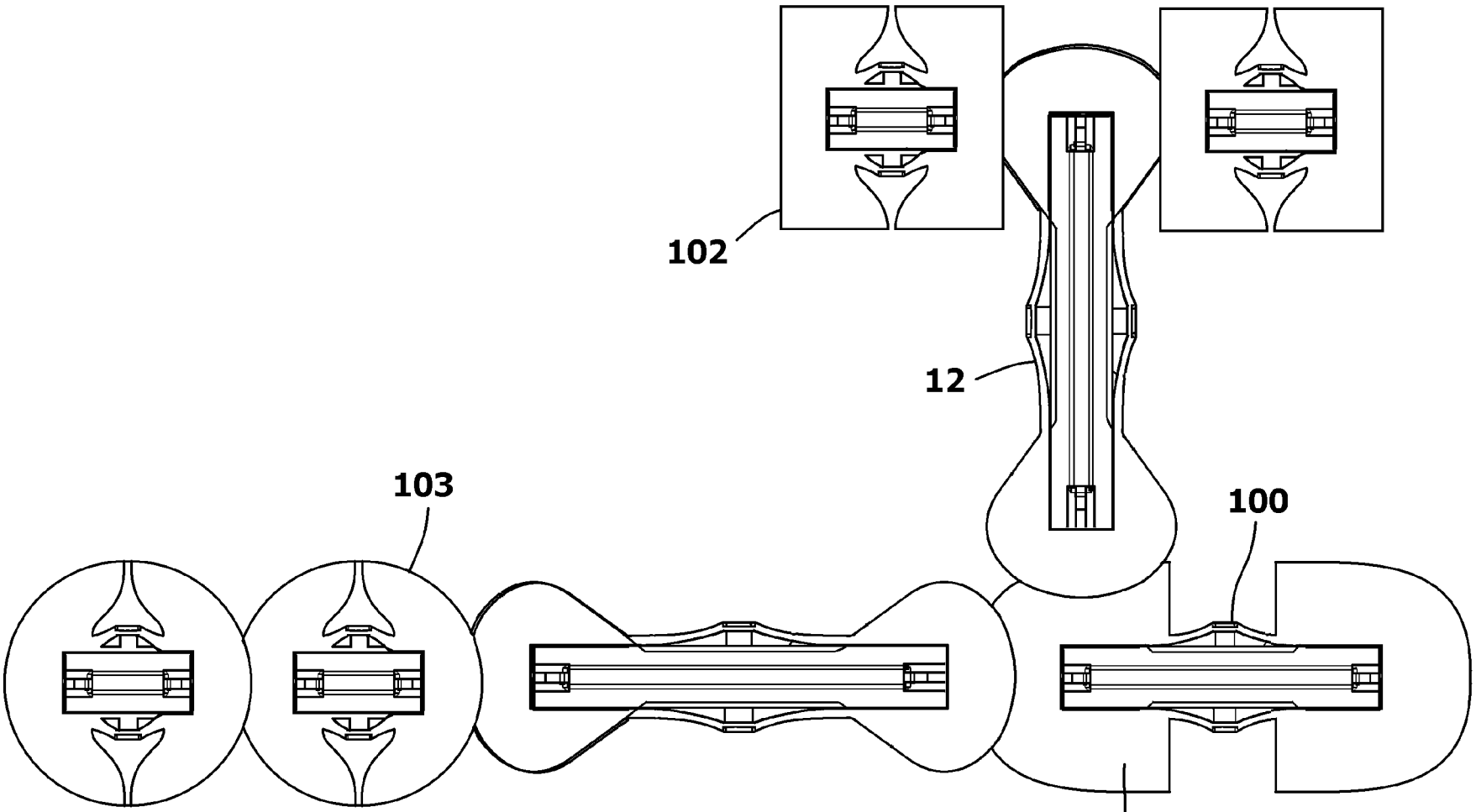
FIG. 13 is a top view of a cascading chain containing alternate embodiments of the bi-stable assemblies.

Referring to FIG. 13, it can be seen that bi-stable assemblies 100, 102, 103 of alternate shapes can be utilized with the traditional shape of the bi-stable assembly 12 previously described. One alternate shape for a bi-stable assembly has very broad flanges 104. This enables multiple other bi-stable assemblies to be triggered by the single wide flange bi-stable assembly 100. Other embodiments include bi-stable assemblies 102 that have square profiles and bi-stable assemblies 103 that have circular profiles. These shapes are created by shortening the bodies of the bi-stable assemblies in relation to the flanges and contouring the flanges.

The square bi-stable assemblies 102 and the circular bi-stable assemblies 103 can be interconnected in cascading configurations. The square bi-stable assemblies 102 and the circular bi-stable assemblies 103 can also be made in different colors. In this manner, the square bi-stable assemblies 102 and the circular bi-stable assemblies 103 can be used as pixels in creating a mosaic on a surface. Once the initial bi-stable assembly is triggered, all the bi-stable assemblies will trigger in a cascade, therein causing the entire image of the mosaic to jump and self-destruct.

It will be understood that the embodiments of the present invention that are illustrated and described are merely exemplary and that a person skilled in the art can make many variations to those embodiments. For instance, the length, width, and shape of the bi-stable assemblies can be altered in many ways. Furthermore, the bi-stable assemblies can be shaped to have the appearance of secondary objects, such as animals, insects, or the like. All such embodiments are intended to be included within the scope of the present invention as defined by the claims.

What is claimed is:

1. A jumping toy, comprising:

a first segment having opposing first segment ends;

a second segment having opposing second segment ends, wherein said first segment and said second segment are connected at a scissor joint at a position between said first segment ends and said second segment ends, wherein said first segment and said second segment can rotate about said scissor joint between a first configuration and a second configuration, and a biasing element that biases said jumping toy toward said second configuration, wherein said jumping toy is stable in said first configuration and is biased toward said second configuration when moved out of said first configuration.

2. The jumping toy according to claim 1, wherein said biasing element is selected from a group consisting of elastic bands and springs.

3. The jumping toy according to claim 1, wherein said first segment and said second segment have flanges that extend from said first segment and said second segment.

4. The jumping toy according to claim 3, wherein said jumping toy has a first end and an opposite second end when in said first configuration, wherein said flanges extend from said first end and said second end.

5. The jumping toy according to claim 4, wherein a gap space is disposed between said flanges at said second end, wherein said jumping toy is displaced from being stable in said first configuration when said gap space between said flanges is widened.

6. The jumping toy according to claim 4, wherein said flanges abut at said first end in said first configuration.

7. The jumping toy according to claim 1, wherein said jumping toy automatically moves to said second configuration by said biasing element when moved out of said first configuration.

8. The jumping toy according to claim 7, further including a delay structure for delaying movement of said jumping toy from said first configuration to said second configuration.

9. The jumping toy according to claim 1, wherein said scissor joint bisects both said first segment and said second segment.

10. The jumping toy according to claim 1, wherein said second segment contains an elongated slot.

11. The jumping toy according to claim 10, wherein said first segment extends through said elongated slot in said second segment.

12. A method of activating a plurality of jumping toys in a cascade, said method comprising the steps of;

providing a plurality of jumping toys that can each move between a first configuration and a second configuration, wherein each of said plurality of jumping toys has a first end and an opposite second end when in said first configuration, wherein flanges extend from said second end and a gap space is disposed between said flanges, and wherein each said jumping toy is stable in said first configuration and is biased into said second configuration when said flanges are spread to increase said gap space;

configuring each said plurality of jumping toys into said stable first configuration;

interlapping said plurality of jumping toys to form a cascading chain configuration, wherein said cascading chain configuration has a first jumping toy and a last jumping toy; and triggering said first jumping toy out of said first stable configuration, wherein said first jumping toy begins a cascade of movement that triggers all of said plurality of jumping toys remaining in said cascading chain configuration.

13. The method according to claim 12, wherein triggering said first jumping toy includes engaging said first jumping toy with a manual triggering mechanism and activating said manual triggering mechanism.

14. The method according to claim 12, wherein interlapping said plurality of jumping toys to form said cascading chain configuration includes sequentially positioning said first end of each of said plurality of jumping toys into said gap space of another of said plurality of jumping toys along said cascading chain configuration.

15. The method according to claim 12, wherein interlapping said plurality of jumping toys to form said cascading chain configuration includes sequentially positioning said first end of at least some of said plurality of jumping toys into said gap space of another of said plurality of jumping toys along said cascading chain configuration.

* * * * *